United States Patent [19]

Guyer

[11] 4,453,713

[45] Jun. 12, 1984

[54] LAWN GAME WITH VERTICALLY SLIDABLE TARGETS

[76] Inventor: Reynolds W. Guyer, 33 E. Wentworth Ave., Suite 345, St. Paul, Minn. 55118

[21] Appl. No.: 381,384

[22] Filed: May 24, 1982

[51] Int. Cl.[3] ..... A63B 71/02; A63B 59/00; A63B 63/00

[52] U.S. Cl. ..... 273/118 R; 273/127 A; 273/168

[58] Field of Search ..... 273/118 R, 127 R, 127 A, 273/129 R, 129 K, 56, 407, 177 R, 177 A, 177 B, 176 B, 176 A, 176 E, 409, 393

[56] References Cited

U.S. PATENT DOCUMENTS

| | | | |
|---|---|---|---|
| 269,351 | 12/1882 | Turner | 273/127 |
| 1,537,711 | 5/1925 | Spafford | 273/168 |
| 1,548,081 | 8/1925 | Wilson | 273/168 X |
| 2,520,392 | 8/1950 | Flenghi | 273/95 |
| 3,024,024 | 3/1962 | Chalcroft | 273/1 |
| 3,048,405 | 8/1962 | McCaul | 273/177 R |
| 3,231,278 | 1/1966 | Boulanger | 273/118 R |
| 3,761,087 | 9/1973 | Meyer | 273/127 R X |
| 3,858,888 | 1/1975 | Young | 273/177 R |
| 4,248,428 | 2/1981 | Vilches | 273/118 R |
| 4,261,570 | 4/1981 | Switzer | 273/127 B |
| 4,330,130 | 5/1982 | Carr | 273/393 |

FOREIGN PATENT DOCUMENTS

| | | | |
|---|---|---|---|
| 419300 | 3/1947 | Italy | 273/127 R |

*Primary Examiner*—Richard T. Stouffer
*Assistant Examiner*—William H. Honaker
*Attorney, Agent, or Firm*—Kinney & Lange

[57] ABSTRACT

A game apparatus for playing a lawn game of entertainment comprises a plurality of generally upright targets, a plurality of balls, and a plurality of mallets for striking the balls. In addition, a plurality of boundary stakes are used to establish the boundaries of play on a playing surface. Each target has a base and an elongated upright, with the base being positioned on the playing surface or lawn and the upright formed to be retained slidably in a generally vertical position on an upwardly extending portion of the base. Preferably, each player of the game has three balls and a mallet, which is used for striking the balls to selectively advance each ball across the playing surface and into contact with selected uprights. Each upright is retained slidably on its base to normally be maintained against tipping, but when a ball contacts the upright with sufficient force, the upright tips and slides off of the base onto the playing surface.

20 Claims, 7 Drawing Figures

LAWN GAME WITH VERTICALLY SLIDABLE TARGETS

BACKGROUND OF THE INVENTION

1. Field of the Invention

The present invention relates to lawn game apparatus.

2. Description of the Prior Art

Lawn games have been devised and played as a means of entertainment for many years. Perhaps the most commonly recognized lawn game is croquet, which employs stakes and wire hoops driven into the ground to form a playing circuit. Each player has a wooden ball and a mallet for striking the ball to send it through the hoops and into contact with the stakes.

Other games and apparatus of this nature are described in U.S. patents. For instance, U.S. Pat. No. 269,351 discloses a game of lawn pool having cups which are secured to the ground (either at ground level or raised by an elongated stake). Each cup has an upper surface upon which a ball rests and in playing the game, a player attempts to knock all the balls off of all the cups in succession with another ball driven across the ground by a mallet.

Another patent employing balls and targets is U.S. Pat. No. 4,261,570. Each target of this patent consists of a stake driven into the ground which has a bell-like cylinder hanging from its upper end. The game is played by players attempting to contact selected targets with a ball driven across the ground by a mallet so that each cylinder will strike its stake and produce a sound indicative of the fact that the target has been hit by the ball.

U.S. Pat. No. 2,520,392 also describes a game target, but the object used to strike the target in this game is a disc rather than a ball. In this patent, the target consists of a pin and a base. A spike on the underside of the base is driven into the lawn so that a flat top surface of the base is positioned on a horizontal plane facing upwardly. The pin has a flat bottom surface and is placed for play on the flat top surface of the base. The game is played by players attempting to knock down the pins with the disc. Additional lawn games employing balls and targets are shown in U.S. Pat. Nos. 3,024,024 and 4,248,428.

The present invention differs from the prior art lawn games in several respects. The mallet used in striking the balls of the present invention is formed so that the balls may be imparted with loft when playing the game. Each upright target of the present invention is formed to be slidably retained on an upwardly extending portion of its base and the targets are assigned different values which cooperatively indicate the order of play of the game. Each player or team has a plurality of balls with which to play the game rather than just one, so that the mallet, value-bearing targets, and plurality of balls provide apparatus wherein a game can be played employing rules which increase the interest and entertainment value of the game. The game apparatus of the present invention is simple of construction and design, thus providing an easily played and economical game of entertainment.

SUMMARY OF THE INVENTION

The present invention is concerned with an apparatus for playing a lawn game of entertainment and amusement. The apparatus has a plurality of generally upright targets with each target having a base and a separate elongated upright. In playing the game, the base of each target is positioned on a playing surface and the upright is placed on the base. The upright is formed to be retained slidably in a generally vertical position on an upwardly extending portion of the base. Each player or team has a plurality of balls and a mallet is provided for striking the balls to selectively advance each ball across the playing surface and into contact with selected uprights. Each upright is normally maintained in an upstanding position on the base but when contacted by a ball with sufficient force, the upright tips and slides off of the base. A plurality of boundary stakes are used for establishing the boundaries of play on the playing surface.

In the preferred embodiment, the base of each target has a spike extending downwardly which is driven into the playing surface to secure the base thereto. An edge portion extends upwardly from the base and the elongated upright is formed at one end to slide over the edge portion of the base so that the upright is retained for play in a generally vertical position on the base. As stated, a mallet is provided for striking the balls during play. Preferably, the mallet has a handle with a head at one end which has four striking surfaces: a front surface, a rear surface and two side surfaces. The front and rear surfaces are slanted away from the ball at impact to impart loft to the ball with the rear surface having a greater degree of slant than the front surface to provide a greater degree of loft at impact.

DETAILED DESCRIPTION OF THE PREFERRED EMBODIMENTS

Figure 1:
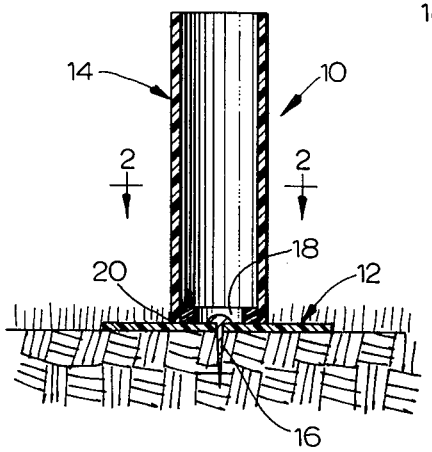
FIG. 1 is a sectional view of the game target of the present invention.

FIG. 1 shows a target 10 consisting of base 12 and an elongated upright 14. A plurality of such targets 10 are used in playing the game of the present invention. Each base 12 has suitable means for securing the base 12 to a playing surface, such as a spike 16 extending downwardly from an underside of the base. Positioned on a top of the base 12 is an upwardly extending portion 18 used for maintaining the upright 14 on the base 12.

Figure 2A:
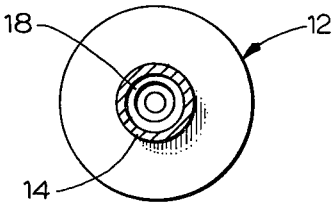
FIGS. 2A and 2B are sectional views taken along line 2—2 of FIG. 1 showing two different embodiments of the upwardly extending edge portion on the base of the target.

Each upright 14 is provided with some sort of indicium indicating the order of play of the game. In the preferred embodiment, the upright 14 has at least one end formed to be retained slidably about the upwardly extending portion 18 of the base 12. As shown in FIGS. 1 and 2A, upwardly extending portion 18 is formed to cooperate with an end 20 of upright 14 so that the upright 14 is retained slidably about upwardly extending portion 18 in a generally vertical position.

Figure 2B:
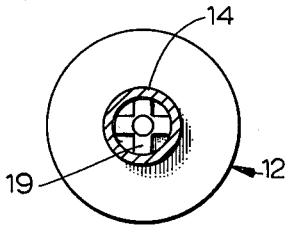

The upwardly extending portion 18 may be of any suitable shape, as long as it cooperates with the shape of the end 20 of the upright 14 to maintain the upright 14 in an upstanding position. For example, when the end 20 is tubular in shape, the upwardly extending portion 18 can be annular (as shown in FIG. 2A) or shaped as a cruciform member 19 (as shown in FIG. 2B). Whatever their shapes, the end 20 and the upwardly extending portion 18 must be formed so that they fit snugly together for retention of the upright 14 in a generally vertical position. Thus, in the embodiment shown in FIG. 2A, the maximum exterior dimension of the upwardly extending portion 18 is substantially the same as the inner diameter of the end 20 of the upright 14 to permit the end 20 to fit snugly over the upwardly extending portion 18. Of course, the relationship between the end 20 and the upwardly extending portion 18 can be reversed. That is, the upwardly extending portion 18 can be formed to fit about the end 20 to maintain the upright 14 in a generally vertical position on the base 12. It should be appreciated that many combinations of shapes are possible between cooperating end 20 and upwardly extending portion 18 so that upright 14 is properly retained on the base 12.

Figure 3:
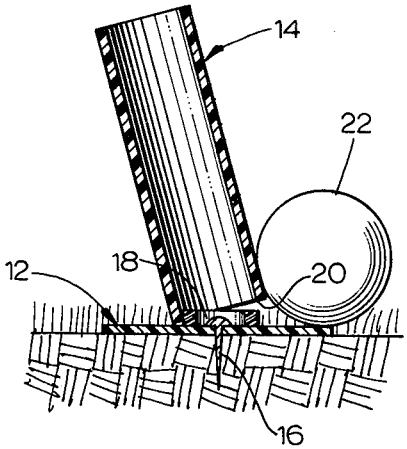
FIG. 3 shows the elongated upright of the target of the present invention sliding off of the base and tipping over after being struck by a ball.

As shown in FIG. 1, upright 14 is normally maintained in an upstanding generally vertical position on the base 12 by upwardly extending portion 18. However, upright 14 can be tipped over and disengaged with base 12 if struck with sufficient force, such as by a ball 22 as illustrated in FIG. 3. The apparatus of the present invention includes a plurality of balls 22 for use in playing the game.

The upwardly extending portion 18 must project upwardly from the base 12 a distance which is sufficiently small to permit the upright 14 to tip when struck by a ball 22, but also must be high enough to prevent tipping too easily. This feature allows for a much more versatile game. The game may be played on a slight incline, since the targets 10 do not need a completely flat surface to be set up for play. The upwardly extending portion 18 will retain the upright 14 of the target 10 even though the base 12 is not absolutely horizontal. Additionally, while the upright 14 can be tipped over by ball 22, it is prevented from being tipped by mere vibration of the playing surface or from gusts of wind. By way of example, components of the following dimensions provide suitable game apparatus as described. The upright 14 consists of a one foot long tube with an outside diameter of two inches which has an inside diameter at one end dimensioned for a snug fit about the upwardly extending portion 18 of the base 12. For an upright 14 of this length, an upwardly extending portion 18 of three-sixteenths of an inch in height is suitable to maintain the upright 14 in the generally vertical position but still allow it to be tipped when struck by a ball 22 of approximately three inches in diameter. Of course, the ball 22 must be of sufficient weight relative to the upright 14 to topple the upright 14 when the ball 22 contacts the upright 14 with sufficient force.

Figure 5:
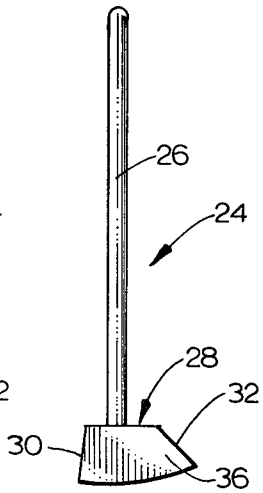
FIG. 5 is a side view of the mallet of FIG. 4 showing specifically the degree of slant on the front and rear surfaces of the mallet.

A mallet 24 is used for striking the balls to advance them across the playing surface during play. Each mallet 24 has a handle 26 with a head 28 at one end thereof. Mallet head 28 has four surfaces for striking the ball 22: a front surface 30, a rear surface 32, and two side surfaces 34 and 36. As shown in FIG. 5, the front surface 30 and rear surface 32 are slanted relative to a generally vertical plane. The slant on the front surface 30 and rear surface 32 is used to impart loft to the ball 22 upon the impact of those surfaces with mallet head 28. As shown, rear surface 32 has a greater degree of slant than front surface 30 to provide a greater degree of loft to the ball 22 at impact. For example, the degree of slant of the front surface 30 from a vertical plane can be 11°-12° and the degree of slant of the rear surface 32 from a vertical plane can be 45°-50°.

Many competitive games are possible using the game apparatus of the present invention. In playing such games, players are pitted against each other individually or by teams. In one such game, each player or team (a side) has a mallet 24 and a plurality of balls 22, preferably three balls 22 per side. Each player or team also has a plurality of targets 10, preferably four targets 10 per side. Any number of players may play the game; however for simplicity of discussion and explanation, the following description of how the game is played is made with reference to a game between only two players—Player X and Player Y.

Figure 6:
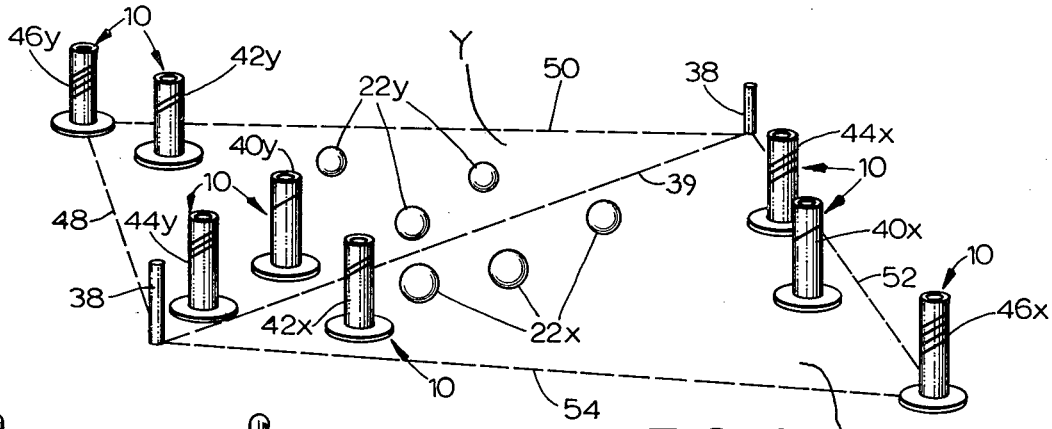
FIG. 6 is a perspective view of the apparatus of the present invention illustrating the relationships of the game's elements during play.
Figure 4:
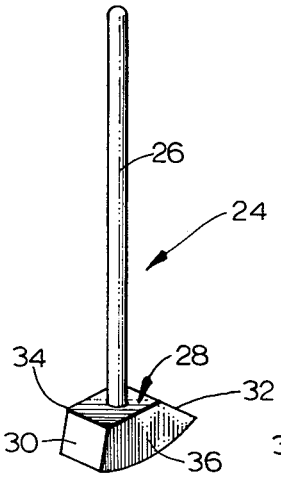
FIG. 4 is a perspective view of the mallet of the present invention.

In setting up the elements of the game for play, the playing surface is first divided into two halves in order to create one home area for each player. As illustrated in FIG. 6, boundary markers 38 are positioned a selected distance from each other on the playing surface (such as from five to fifteen yards apart). The boundary markers 38 can be of any suitable configuration, such as a wooden stake with a pointed end so that it can be readily driven into the ground (as in FIG. 6) or a wire holder pushed into the ground with a flag at its upper end. The boundary markers 38 serve to define certain boundaries of play on the playing surface. The boundary markers 38 have distinctive indicia thereon, such as a contrasting color, to set them apart from the other components of the game. A straight line passing through the position of each boundary marker 38 (shown as a dashed line 39 in FIG. 6) forms a boundary line between Player X's home area X (generally below the line 39 in FIG. 6) and Player Y's home area Y (generally above the line 39 in FIG. 6).

As stated, each player has four targets 10. The targets are identical in structure except that each target bears a different indicium thereon which indicates the order in which the game is played. The targets of Player X are identical to the targets of Player Y in structure. To differentiate the targets of Player Y from the targets of Player X, a system of notation is used herein. A suffix "x" is applied to all targets of Player X and a suffix "y" is applied to all targets of Player Y. Each player has four targets 10 with indicia thereon indicating the order of play. Player X has a first target 40*x*, a second target 42*x*, a third target 44*x*, and a fourth target 46*x*. Similarly, Player Y has a first target 40*y*, a second target 42*y*, a third target 44*y*, and a fourth target 46*y*. The order-of-play indicia can be in the form of letters, numerals, colors or stripes visible on the targets. In FIG. 6, each first target 40*x* and 40*y* has one stripe, each second target 42*x* and 42*y* has two stripes, each third target 44*x* and 44*y* has three stripes, and each fourth target 46*x* and 46*y* has four stripes.

To differentiate the players' targets, the targets of Player X are of a contrasting color to the targets of Player Y. Other forms of differentiation are, of course, also possible.

The fourth targets 46*x* and 46*y* are also used to establish boundaries of play in setting up the game. Once the boundary markers 38 have been positioned and the playing surface divided in half, the fourth targets 46x and 46y of the players are positioned an equal distance from each boundary marker 38 (the same distance for both players) on each player's home side of the boundary line 39. The placement of the fourth targets 46x and 46y is illustrated in FIG. 6. The placement of fourth targets 46x and 46y create triangles (shown by the dashed lines 39, 48, 50, 52 and 54 in FIG. 6) within each player's home area, the corners of each triangle being the fourth target 46x or 46y and the boundary markers 38.

The three remaining targets 10 for each player are positioned at the player's discretion within the triangle of that player's home area. The spike 16 of the base 12 of each target 10 is driven into the ground and the upright 14 of each target 10 is slid onto the upwardly extending portion 18 of the base 12 so that the upright 14 is retained in a generally vertical position.

As stated, each Player X and Y has three balls 22. To differentiate the balls of Player X from those of Player Y, a similar notation system is necessary. Player X's balls are referred to as balls 22x and Player Y's balls are referred to as balls 22y. To complete setting up the game for play, each player places that player's three balls 22 within the triangle of that player's home area in any desired arrangement. The only restriction on the placement of a player's balls 22 is that each ball 22 must be within the triangle of the player's home area but not within a mallet's length from any one of the player's four targets 10. Preferably, each player's balls 22 bear a similar indicium (such as color) which is different from that borne by the other player's balls 22. As shown in FIG. 6, Player X's balls 22x and targets 40x, 42x, 44x and 46x are positioned in Player X's home area X and Player Y's balls 22y and targets 40y, 42y, 44y and 46y are positioned in Player Y's home area Y. With the game apparatus positioned as described and shown in FIG. 6, the game is ready to begin play.

The object of the game is a sequential "capture" of the other player's targets 10. The stripes on the targets 10 provide the sequential order of play. Using Players X and Y as an example, Player X will win the game by tipping over PlayerY's four targets 40y, 42y, 44y and 46y before Player Y has tipped over all of Player X's targets 40x, 42x, 44x and 46x in order. It is important that the opponent's targets be tipped over sequentially. For example, if Player X tipped over Player Y's target 44y before tipping over Player Y's target 42y, target 44y would be repositioned on its base in a generally vertical position as if it had not been knocked over by Player X. The fourth targets 46x and 46y are the last targets 10 to be tipped over when playing the game, although they are the first targets 10 to be positioned on the playing surface in preparation for play.

Each player is provided with three balls 22 not only to attempt to "capture" the other player's targets 10, but also for defensive purposes. A player can take a defensive posture and defend that player's targets 10 from being struck by the other player's balls 22. For example, Player X can defend target 40x by positioning one of the balls 22x between one of Player Y's balls 22y and the target 40x being protected, as shown in FIG. 6. However, because of the unique shape of the front surface 30 and rear surface 32 of the mallet head 28, a calculated shot by Player Y can loft the ball 22y over Player X's ball 22x in order to strike target 40x.

To further complicate the offensive and defensive strategies of the players, the rules of the game provide that if one of Player Y's balls 22y is in Player X's home area and strikes, or is struck by, one of Player X's balls 22x, then Player Y must reposition that ball 22y back in Player Y's home area one mallet length from Player Y's fourth target 46y. The same rule applies to Player X when the balls 22x of Player X are in Player Y's home area. Thus, when one of Player X's balls 22x touches one of Player Y's balls 22y in Player Y's home area, Player X is penalized by having to place the struck ball 22x back near Player X's fourth target 46x.

The game is played by each player taking alternating turns. A turn consists of a player striking one of that player's balls with the mallet to advance the ball across the playing surface. The only time a player is granted an extra shot in a turn is when the player topples one of the opponent's targets in the proper sequence. For example, if one of Player X's balls 22x struck and tipped over Player Y's first target 40y, Player X would be awarded an extra shot in that turn. Player X could take this shot with any one of Player X's three balls 22x. Each player or team of players can be provided with a mallet 24; however, the game can be played using only one mallet 24 shared by all the players during their respective turns.

By using the apparatus of the present invention and the simple rules outlined above, a lawn game may be played which is of amusement to players of all ages. The game and apparatus are quite simple to understand and use so that young players are entertained, while the possibility for offensive and defensive strategy using the various balls controlled by a player provides an entertaining pastime for older players as well. Of course, the rules of the game can be altered in many ways without changing the apparatus used in playing the game. For example, a player may have more (or fewer) than three balls or four stakes, or each player or team may take more than one shot per turn.

CONCLUSION

The present invention provides apparatus for an entertaining lawn game which is simple to set up and play. A plurality of targets are positioned within predetermined boundaries on a playing surface with each target having an upright slidably mounted on a base. The components are formed so that the upright is retained on the base (even on a slight incline) but can be tipped and disengaged with the base if struck by a ball with sufficient force. The mallets used to strike the balls have slanted surfaces so that the balls can be lofted across portions of the playing surface.

Although the present invention has been described with reference to preferred embodiments, workers skilled in the art will recognize that changes may be made in form and detail without departing from the spirit and scope of the invention.

What is claimed is:

1. A game apparatus comprising:

a plurality of generally upright targets, each target having a base and an elongated upright, the base being positioned on a playing surface, and the upright being formed to be vertically slidably retained in a generally vertical position on an upwardly extending portion on the base, the coacting sliding portions being of sufficient extent to keep the upright in the generally vertical position against such tipping forces as the wind and those resulting from vibration but sufficiently short to allow tipping of the upright away from the base when the upright is hit with sufficient force;

a plurality of balls; and a mallet for striking the balls to selectively advance each ball across the playing surfaces and into contact with selected uprights with sufficient force to tip each upright by causing it to slide off of its base.

2. The game apparatus of claim 1 and further comprising:

means for detachably securing the base to the playing surface.

3. The game apparatus of claim 2 wherein the securing means is a spike extending downwardly from the base which is driven into the playing surface to secure the base thereto.

4. The game apparatus of claim 1, and further comprising a plurality of boundary markers for establishing boundaries of play on the playing surface, with a portion of the boundary markers being constituted by at least one of the upright targets.

5. The game apparatus of claim 1 wherein the mallet has a handle having a head at one end thereof, the head having a front surface, a rear surface and two side surfaces for striking the ball, the front and rear surfaces being slanted away from the ball at impact to impart loft to the ball, and the rear surface having a greater degree of slant than the front surface to provide a greater degree of loft.

6. The game apparatus of claim 1 wherein the base has an edge portion extending upwardly and the upright is formed at one end to slide over the edge portion of the base so that the upright is retained for play in a generally vertical position on the base.

7. The game apparatus of claim 6 wherein the edge portion of the base is annular.

8. The game apparatus of claim 6 wherein the edge portion of the base is cruciform.

9. The game apparatus of claim 1 wherein each player of the game has a plurality of targets, each target of each player has a different indicium thereon, and the indicium defines the order of play of the game.

10. A game apparatus for playing a two-sided game comprising:

a plurality of generally upright targets for each side, each target for each side having a base, an elongated upright and a different indicium thereon which defines the order of play of the game, the base for each target being positioned on a playing surface, and its respective upright being formed to be vertically slidably retained in a generally vertical position with respect to an upwardly extending portion of the base;

a plurality of boundary markers for establishing boundaries of play on the playing surface;

a plurality of balls for each side; and a mallet for striking the balls to selectively advance each ball of a side across the playing surface and into contact with selected uprights of the other side in order as defined by the indicia thereon, and each upright being vertically slidably retained on its base with sufficiently minimal structure to allow the upright to tip and slide off of the base when a ball contacts the upright with sufficient force.

11. The game apparatus of game 10 wherein at least one target for each side is positioned to further define that side's playing area.

12. The game apparatus of claim 10 and further comprising:

means for detachably securing the base to the playing surface.

13. The game apparatus of claim 12 wherein the securing means is a spike extending downwardly from the base which is driven into the playing surface to secure the base thereto.

14. The game apparatus of claim 10 wherein the mallet has a handle having a head at one end thereof, the head having a front surface, a rear surface and two side surfaces for striking the ball, the front and rear surfaces being slanted away from the ball at impact to impart loft to the ball, and the rear surface having a greater degree of slant than the front surface to provide a greater degree of loft.

15. The game apparatus of claim 10 wherein the base has an edge portion extending upwardly and the upright is formed at one end to slide over the edge portion of the base so that the upright is retained for play in a generally vertical position on the base.

16. The game apparatus of claim 15 wherein the edge portion of the base is annular.

17. The game apparatus of claim 15 wherein the edge portion of the base is cruciform.

18. A game apparatus comprising:

a plurality of generally upright targets, each target having a base and an elongated upright, the base being positioned on a playing surface, and the upright being formed to be vertically slidably retained in a generally vertical position on an upwardly extending portion on the base, the coacting sliding portions being of sufficient extent to keep the upright in the generally vertical position against such tipping force as the wind and those resulting from vibration but sufficiently short to allow tipping of the upright away from the base when the upright is hit with sufficient force;

a pair of spaced apart boundary stakes positioned with respect to the playing surface so that a line passing through the stakes divides the playing surface into two playing areas, one playing area for each side, with the targets for each side being positioned on that side's playing area;

a plurality of balls; and a mallet for striking the balls to selectively advance each ball across the playing surface and into contact with selected uprights with sufficient force to tip each upright by causing it to slide off of its base.

19. The game apparatus of claim 18 wherein at least one target for each side is positioned to further define that side's playing area.

20. The game apparatus of claim 18 wherein each side of the game has a plurality of targets, each target of each side has a different indicium thereon, and the indicium defines the order of play of the game.

* * * * *